US008441328B2

(12) United States Patent
Shin

(10) Patent No.: US 8,441,328 B2
(45) Date of Patent: May 14, 2013

(54) ELECTROSTATIC SWITCH FOR HIGH FREQUENCY AND METHOD FOR MANUFACTURING THE SAME

(75) Inventor: Kwang-Jae Shin, Yongin (KR)

(73) Assignee: Mems Solution Inc., Yongin (KR)

( * ) Notice: Subject to any disclaimer, the term of this patent is extended or adjusted under 35 U.S.C. 154(b) by 313 days.

(21) Appl. No.: 12/958,827

(22) Filed: Dec. 2, 2010

(65) Prior Publication Data

US 2011/0133851 A1 Jun. 9, 2011

(30) Foreign Application Priority Data

Dec. 3, 2009 (KR) ..... 10-2009-0119350

(51) Int. Cl.
*H01P 1/10* (2006.01)

(52) U.S. Cl.
USPC ..... 333/105; 333/262

(58) Field of Classification Search ..... 333/101, 333/104, 105, 262; 200/181
See application file for complete search history.

(56) References Cited

U.S. PATENT DOCUMENTS

| | | | | |
|---|---|---|---|---|
| 6,426,687 | B1 * | 7/2002 | Osborn | 333/262 |
| 6,621,387 | B1 * | 9/2003 | Hopcroft | 333/262 |
| 6,639,488 | B2 * | 10/2003 | Deligianni et al. | 333/101 |
| 6,713,695 | B2 * | 3/2004 | Kawai et al. | 200/181 |
| 7,978,045 | B2 * | 7/2011 | Lee et al. | 337/14 |

* cited by examiner

*Primary Examiner* — Dean O Takaoka
(74) *Attorney, Agent, or Firm* — Finnegan, Henderson, Farabow, Garrett & Dunner, L.L.P.

(57) ABSTRACT

An electrostatic switch for high frequency and a method for manufacturing the same are disclosed. The electrostatic switch for high frequency in accordance with an embodiment includes: a first substrate module including a first substrate, an electrode part and a pair of CoPlanar Waveguides (CPWs), the electrode part being installed on the first substrate, the pair of CPWs being formed on either side of the electrode part and guiding an RF signal to travel; and a second substrate module being joined to the first substrate module, the second substrate module including a membrane and a bias line, the membrane being installed on a second substrate and bent by bias voltage supplied to the electrode part and being coupled to the pair of CPWs across an upper area of the electrode part in order to be short-circuited to the electrode part, the bias line being connected to the electrode part.

11 Claims, 4 Drawing Sheets

ELECTROSTATIC SWITCH FOR HIGH FREQUENCY AND METHOD FOR MANUFACTURING THE SAME

CROSS-REFERENCE TO RELATED APPLICATIONS

This application claims the benefit of Korean Patent Application No. 10-2009-0119350, filed with the Korean Intellectual Property Office on Dec. 3, 2009, the disclosure of which is incorporated herein by reference in their entirety.

BACKGROUND

1. Technical Field

The present invention is related to an electrostatic switch for high frequency and a method for manufacturing the electrostatic switch for high frequency, more specifically to an electrostatic switch for high frequency and a method for manufacturing the electrostatic switch for high frequency that can be applied with the MEMS technology, can be simpler in the manufacturing process through improvement of the structure and can be made smaller.

2. Description of the Related Art

With the recent technological development of ultra-compact precision devices, electronic components, such as a switch, installed in these devices are increasingly required to be smaller, lighter and more high-functional. Accordingly, there has been an increased demand for application of the MEMS (Micro Electro Mechanical System) technology.

The electrostatic switch applied with the MEMS technology, which is an electrical switch substituted by a mechanical switch, has an improved insertion loss characteristic in a high frequency band and shows superb signal separation. Moreover, not only is the power loss reduced according to the switch driving method, but the linearity is improved and the distortion and interference of a signal can be reduced.

FIG. 1 is a sectional view of a conventional electrostatic switch for high frequency.

A conventional electrostatic switch for high frequency 10 includes a lower substrate 12, on which an insulating film 11 is formed, and an electrode part 14, which is formed above the lower substrate 12. A pair of CoPlanar Waveguides (CPWs) 16, which are for allowing an RF signal to pass, are formed on either side of the electrode part 14.

Formed above the electrode part 14 is a dielectric 15. Installed above the pair of CPWs 16 across an upper area of the electrode part 14 is a membrane 18, and a gap is provided between the electrode part 14 and the membrane 18 by the height of the CPWs 16.

The pair of CPWs 16 guide the RF signal to pass. Electric power applied when a signal is generated is supplied to the electrode part 14, and an electromagnetic field is formed around the electrode part 14. The electromagnetic force of the electromagnetic field around the electrode part 14 pulls the membrane 18, which is then bent and makes contact with the dielectric 15 of the electrode part 14.

A method for manufacturing the conventional electrostatic switch for high frequency 10 is as follows.

First, the electrode part 14 is installed above the lower substrate 12, and the dielectric 15 is installed above the electrode part 14.

Then, after the CPWs 16 are formed, a sacrificial layer is formed above the lower substrate 12 and the dielectric 15. Here, the sacrificial layer is formed with a thickness that is sufficient for the membrane 18 to bend easily.

Afterwards, an area of the sacrificial layer excluding the pair of CPWs 16 is removed between the membrane 18 and the electrode part 14.

FIG. 2 is a sectional view of a conventional electrostatic switch for high frequency in accordance with another embodiment.

Referring to FIG. 2, an electrostatic switch for high frequency 20 has an electrode part 24 formed above a lower substrate 22 and a dielectric 25 formed above the electrode part 24.

Formed on either side near the electrode part are CPWs 26, above which a membrane 28 is installed. The membrane 28 is separated from the electrode part 24 by a certain distance, for which arch-shaped anchors are formed over the CPWs 26 on either side of the membrane 28.

In this type of electrostatic switch for high frequency 24, an electromotive force can be generated by bias voltage inputted to the electrode part 24, and the membrane 28 can be deformed about the anchors and make contact with the electrode part 24.

In the conventional electrostatic switch for high frequency 10, 20, it is required to introduce a process of using/removing a sacrificial layer in order to form a gap between the membrane 18, 28 and the electrode part 14, 24. Here, used for the sacrificial layer can be polymer, such as polyimide or photoresist, or oxide/nitride film. However, materials that can be used for the sacrificial layer are limited depending on the preceding/following process, and use of the sacrificial layer is also limited depending on the materials used in the preceding/following process or the material used in the sacrificial layer.

In the electrostatic switch for high frequency 10 having a pair of CPWs 16, the membrane 18 needs to be maintained flat in order to provide the structural stability. However, some etching can occur on an upper portion of the CPWs 16 during the removal of the sacrificial layer, and accordingly it becomes difficult to form the upper portion of the CPWs 16 flat. As such, the manufacturing process of the electrostatic switch for high frequency 10 having the CPWs 16 does not allow for a perfectly flat structure and thus encompasses an inherent structural weakness.

Moreover, in the electrostatic switch for high frequency 20 in which the membrane 28 is supported by the anchors, the deformation of the membrane 28 can cause fatigue in the structure to be accumulated with an extended use and can result in damage.

In addition, an additional process of protecting a chip by capping an upper portion of the membrane 18, 28 has been conventionally required in order to protect the structure and maintain the characteristics after the electrostatic switch for high frequency 10, 20 is made. This, however, makes the manufacturing process more complex, increasing the manufacturing cost and lowering the production yield.

Furthermore, since a connection electrode for mounting the electrostatic switch for high frequency 10, 20 needs to be formed after the conventional the electrostatic switch for high frequency 10, 20 is packaged, the overall size of the product becomes is increased and an additional process for forming the connection electrode is required.

SUMMARY

The present invention provides an electrostatic switch for high frequency and a method for manufacturing the electrostatic switch for high frequency that can use the MEMS technology and improve the structure and manufacturing process of the electrostatic switch for high frequency.

An aspect of the present invention features an electrostatic switch for high frequency. The electrostatic switch for high frequency in accordance with an embodiment of the present invention can include: a first substrate module including a first substrate, an electrode part and a pair of CoPlanar Waveguides (CPWs), the electrode part being installed on the first substrate, the pair of CPWs being formed on either side of the electrode part and guiding an RF signal to travel; and a second substrate module being joined to the first substrate module, the second substrate module including a membrane and a bias line, the membrane being installed on a second substrate and bent by bias voltage supplied to the electrode part and being coupled to the pair of CPWs across an upper area of the electrode part in order to be short-circuited to the electrode part, the bias line being connected to the electrode part.

The electrostatic switch for high frequency can also include a sealing part, which is installed on and sealing around at least one of the first substrate module and the second substrate module and maintains a constant height.

In the electrostatic switch for high frequency, a dielectric layer can be stacked over the electrode part being short-circuited with the membrane.

The electrostatic switch for high frequency can also include a via connecting part, which is formed on a rear surface of the first substrate module and is electrically connected to an internal circuit that includes the electrode part and the bias line.

The membrane can be a conductive material including metal, poly-Si and SiC.

The first substrate module and the second substrate module can be joined by use of at least one of Au—Au welding, eutectic bonding including Au—Sn, Au—In and Cu—Sn, and polymer bonding.

Another aspect of the present invention features a method for manufacturing an electrostatic switch for high frequency. The method for manufacturing an electrostatic switch for high frequency in accordance with an embodiment can include: preparing a first substrate module including a first substrate, an electrode part and a pair of CoPlanar Waveguides (CPWs), the electrode part being installed on the first substrate, the pair of CPWs being formed on either side of the electrode part and guiding an RF signal to travel; preparing a second substrate module including a second substrate and a membrane, the membrane being installed on the second substrate and bent by bias voltage supplied to the electrode part and being short-circuited to the electrode part; and joining the first substrate module with the second substrate module so that the membrane is coupled to the pair of CPWs across an upper area of the electrode part.

The first substrate module can be prepared by: forming a first insulation membrane on the first substrate; forming an electrode layer above the first insulation membrane; forming a dielectric layer above the electrode layer; removing areas of the dielectric layer other than an area of the dielectric layer corresponding to the electrode part; forming the electrode part by removing the electrode layer exposed by removal of the dielectric layer; and forming the pair of CPWs on either side of the electrode part.

The second substrate module can be prepared by: forming a second insulation membrane on the second substrate; forming a sacrificial layer above the second substrate on which the second insulation membrane is formed; forming a membrane and a bias line above the sacrificial layer; and removing the sacrificial layer formed in a space in which the membrane is being deformed.

The first substrate module and the second substrate module can be joined by use of at least one of Au—Au welding, eutectic bonding including Au—Sn, Au—In and Cu—Sn, and polymer bonding.

In another embodiment of the present invention, the method for manufacturing an electrostatic switch for high frequency, which includes a substrate, an electrode part installed on the substrate, a pair of CoPlanar Waveguides (CPWs) installed on either side of the electrode part, a membrane coupled to the CPWs, and a bias line connected to the electrode part, can include forming a via connecting part, which is electrically connected to an internal circuit that includes the electrode part and the bias line, in a bottom portion of the substrate. The via connecting part can be formed by: removing a first insulation membrane in the bottom portion of the substrate; forming a via hole in the bottom portion of the substrate, the via hole exposing the internal circuit through a pattern of the via connecting part; and connecting the internal circuit with an outside through the pattern of the via connecting part by forming a conductive material on the substrate and the via hole.

DETAILED DESCRIPTION

Figure 1:
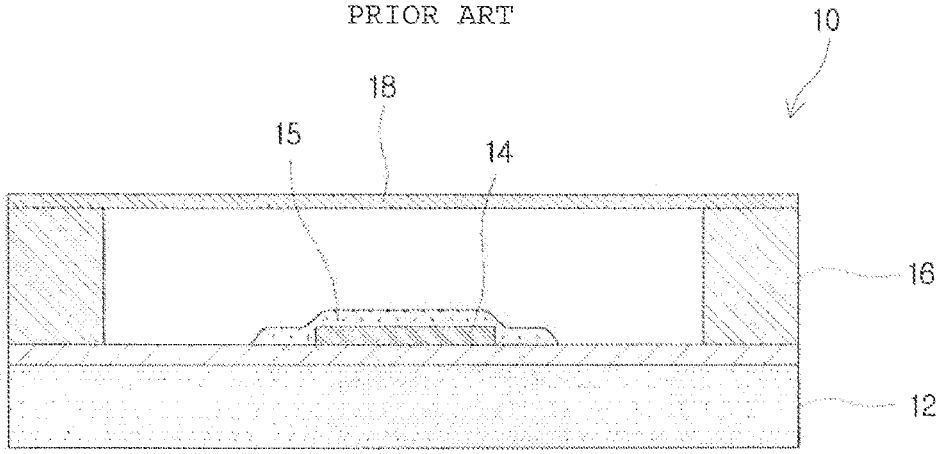
FIG. 1 PRIOR ART
FIG. 1 is a sectional view of a conventional electrostatic switch for high frequency.
Figure 2:
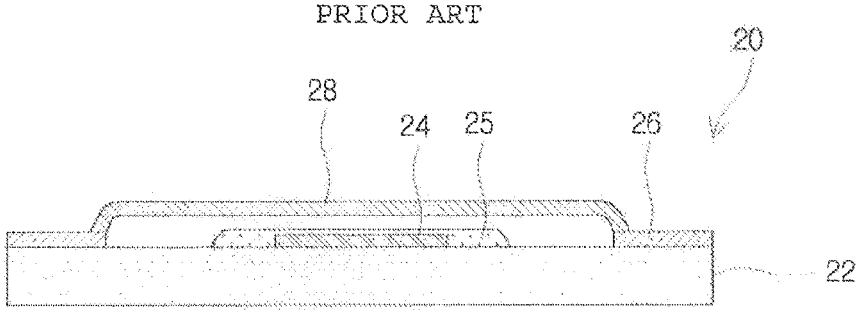
FIG. 2 PRIOR ART
FIG. 2 is a sectional view of a conventional electrostatic switch for high frequency in accordance with another embodiment.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the ideas and scope of the present invention. Throughout the description of the present invention, when describing a certain technology is determined to evade the point of the present invention, the pertinent detailed description will be omitted.

Hereinafter, some embodiments of the present invention will be described in detail with reference to the accompanying drawings. Identical or corresponding elements will be given the same reference numerals, regardless of the figure number, and any redundant description of the identical or corresponding elements will not be repeated.

Figure 3:
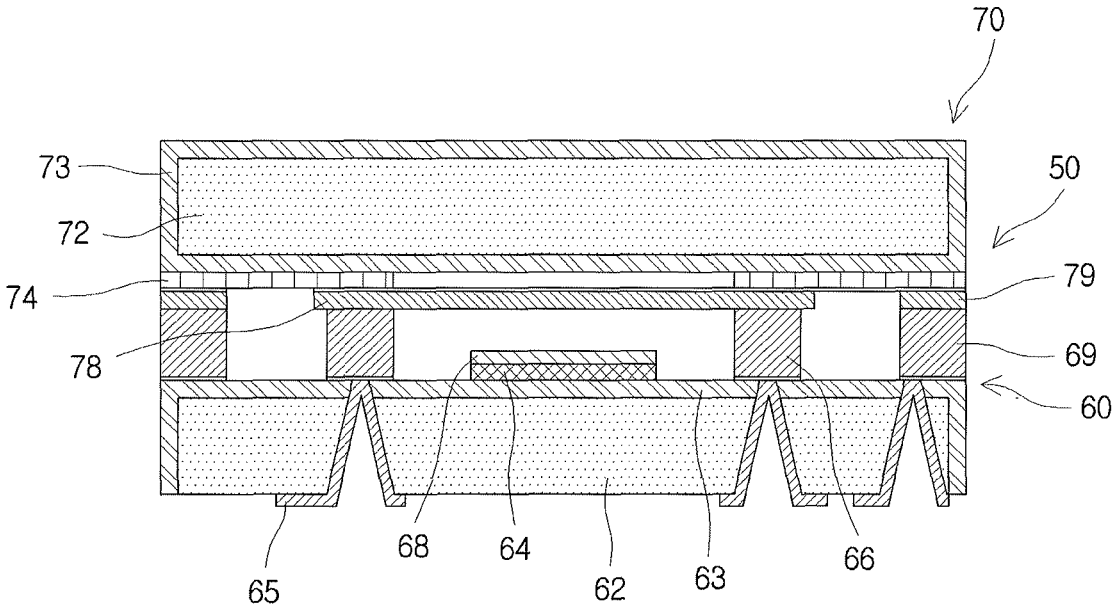
FIG. 3 is a sectional view of an electrostatic switch for high frequency in accordance with an embodiment of the present invention.

FIG. 3 is a sectional view of an electrostatic switch for high frequency in accordance with an embodiment of the present invention.

As shown in FIG. 3, an electrostatic switch for high frequency 50 in accordance with the present embodiment includes a first substrate module 60 and a second substrate module 70, and is formed by joining the first substrate module 60 and the second substrate module 70 in one body.

The first substrate module 60 includes a first substrate 62, which is a base layer, and a first insulation membrane 63 is formed on a surface of the first substrate 62.

In the present embodiment, the first insulation membrane 63 can be made of silicon nitride (SiNx).

A silicon nitride layer has an excellent mechanical strength, and a silicon oxide layer can be additionally formed on a surface of the silicon nitride layer in order to prevent the silicon nitride layer from being damaged by, for example, etching.

An electrode part 64 is formed above the first insulation membrane 63.

The electrode part 64 can be made of a material that has a good RF signal transmissibility, for example, aluminum (Al), gold (Au), copper (Cu), platinum (Pt), molybdenum (Mo), tungsten (W) and ruthenium (Ru).

Formed on either side of the electrode part 64 are a pair of CoPlanar Waveguides (CPWs) 66. The CPWs 66 guide an RF signal that travels through the electrode part 64.

Coupled above upper portions of the pair of CPWs 66 is a membrane 78, which is formed on the second substrate module 70.

The membrane 78 is supported by and coupled to the upper portions of the pair of CPWs 66 across an upper area of the electrode part 64 when the first substrate module 60 and the second substrate module 70 are joined. For this, the pair of CPWs 66 are formed to be higher than the electrode part 64. For example, the CPWs 66 can be formed with a sufficient height that the membrane 78 can be bent and shorted by the electrode part 64 by an electromotive force generated by bias voltage applied to the electrode part 64.

In the present embodiment, the membrane 78 can be made of a conductive material, such as metal, poly-Si and SiC.

The second substrate module 70 includes a second substrate 72, which is a base layer, and a second insulation membrane 73 is formed on a surface of the second substrate 72. In the present embodiment, the second substrate 72 can be made of high-resistance silicon (Si), and it is possible that the second substrate 72 is made of glass or polymer.

In the present embodiment, the second insulation membrane 73 can be made of silicon nitride (SiNx). A silicon nitride layer 73 has an excellent mechanical strength, and a silicon oxide layer can be additionally formed on a surface of the silicon nitride layer 73 in order to prevent the silicon nitride layer from being damaged by, for example, etching.

Then, a sacrificial layer 74 is formed below the silicon nitride layer 73.

A membrane 78 is coupled to the sacrificial layer 74, and a portion of the sacrificial layer 74 is removed between the membrane 78 and the second substrate 72 in order to provide a space for the membrane 78 to deform.

In the present embodiment, the sacrificial layer 74 does not affect the flatness when the membrane 78 is coupled to the CPWs 66, and thus can be made of various materials, for example, poly-Si, oxide film, nitride film and polymer, such as polyimide or photoresist.

Moreover, a bias line 76, which is electrically connected to the electrode part 64, is formed on in the second substrate module 70. Driving voltage, which allows the membrane 78 to be in contact with the electrode part 64, can be supplied through this bias line 76.

A dielectric layer 68 can be stacked over the electrode part 64, which is short-circuited with the membrane 78. Here, the dielectric layer 68 can be made of a material having a high dielectric constant, for example, PZT or $ZrO_2$.

The dielectric layer 68 maximizes the capacitance ratio (Cb/Ca) of the membrane 78, which is grounded to the electrode part 64, and thus allows an RF signal to flow to the ground when the membrane 78 is short-circuited with the electrode part 64.

Moreover, a sealing part 69, 79 for sealing up an inside can be installed on any one of the first substrate module 60 and the second substrate module 70.

The sealing part 69, 79 is formed to have the same thickness as that of the CPWs 66 and the membrane 78, and accordingly it is possible to maintain the heights of the first substrate module 60 and the second substrate module 70 while sealing the inside.

In one example, the sealing part can include a first sealing part 69, which is formed around the first substrate module 60, and a second sealing part 79, which is formed around the second substrate module 70 and joined to the first sealing part 69.

The first substrate module 60 and the second substrate module 70 can be joined by use of Au—Au welding, and it is also possible to use eutectic bonding, which uses Au—Sn, Au—In and Cu—Sn, or polymer bonding.

Although the present embodiment is described that the sealing part includes the first sealing part 69 formed on the first substrate module 60 and the second sealing part 79 formed on the second substrate module 70, the structure of the sealing part 69, 79 is not restricted to what is described herein, and it is possible that the sealing part is formed on one of the first substrate module 60 and the second substrate module 70.

In the present embodiment, an electrode being connected to an external circuit is formed in a single body in order to input an RF signal and a bias signal.

For example, a via connecting part 65, which is electrically connected to an internal circuit that includes the electrode part 64 and the bias line 76, is formed on a rear surface of the first substrate module 60. The via connecting part 65 is formed through KOH or TMAH wet etching, and it is also possible to form the via connecting part 65 by a Si deep etching process.

Described below is a method for manufacturing the electrostatic switch for high frequency 50 that is constituted as described above.

Figure 4:
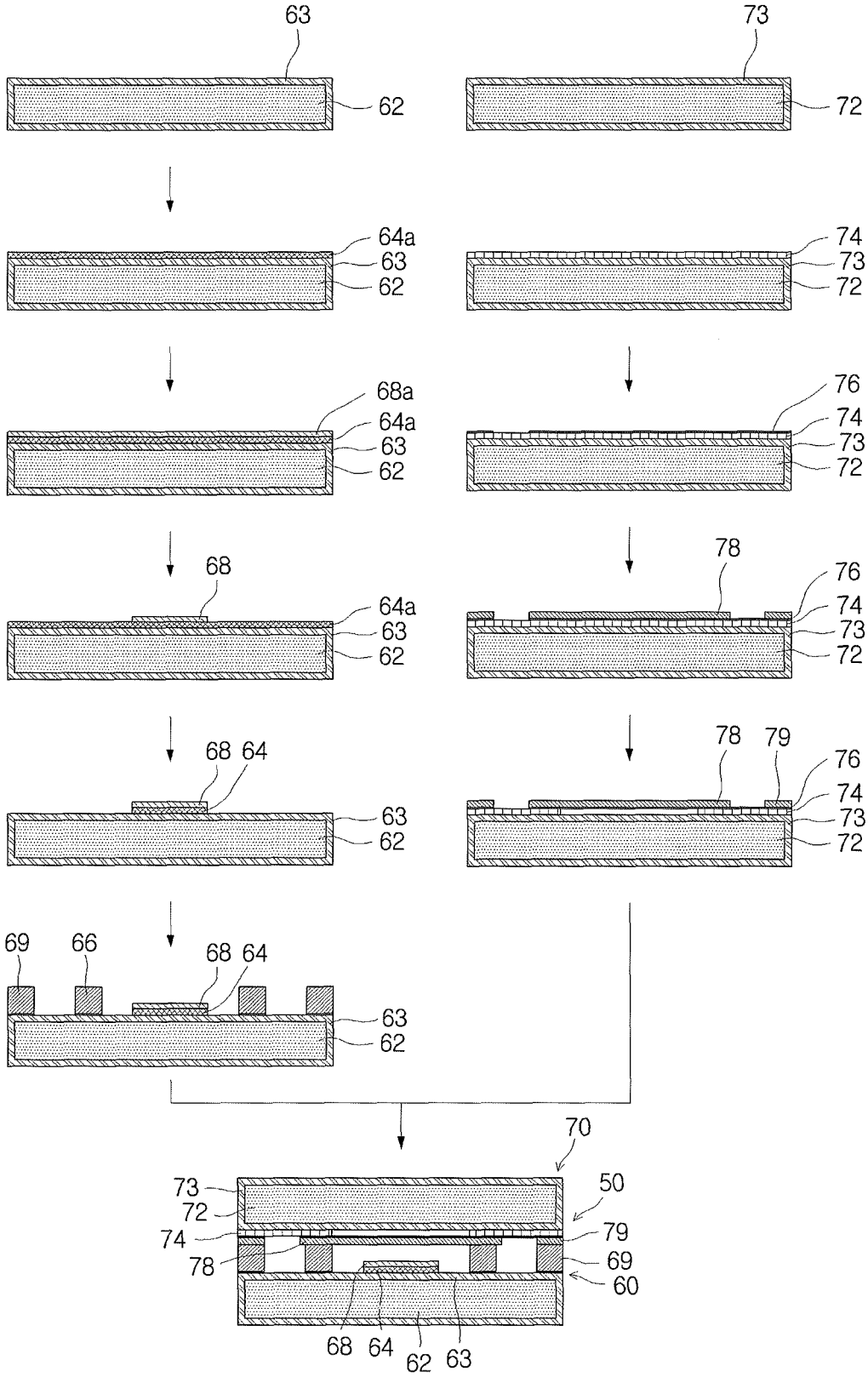
FIG. 4 shows sectional views of processes of manufacturing an electrostatic switch for high frequency in accordance with an embodiment of the present invention.

FIG. 4 shows sectional views of processes of manufacturing an electrostatic switch for high frequency in accordance with an embodiment of the present invention.

Referring to FIG. 4, the method for manufacturing an electrostatic switch for high frequency 50 in accordance with the present embodiment includes preparing a first substrate module 60, preparing a second substrate module 70, and joining the first substrate module 60 and the second substrate module 70 to make a single electrostatic switch for high frequency 50.

In the step of preparing the first substrate module 60, a first insulation membrane 63 is formed on a first substrate 62, which is a base layer.

The first insulation membrane 63 can be formed by stacking a silicon nitride (SiNx) layer on a surface of the first substrate 62 through low-pressure chemical vapor deposition. Moreover, it is also possible to additionally form a silicon oxide layer on a surface of the silicon nitride layer.

Once the first insulation membrane 63 is formed on the first substrate 62, a Pt/Au electrode layer 64*a* is formed over the first insulation membrane 63.

Next, a dielectric membrane 68*a*, which is made of a material having a high dielectric constant, for example, PZT or $ZrO_2$, is formed above the electrode layer 64*a*.

Once the dielectric layer 68*a* is formed above the electrode layer 64*a*, areas of the dielectric membrane 68*a*, excluding an area of the dielectric membrane 68*a* corresponding to a predetermined pattern of an electrode part 64, are etched off.

Accordingly, in an upper part of the electrode layer 64*a*, a dielectric layer 68 is remained in an upper part of the pattern of the electrode part 64.

Then, by etching the electrode layer 64*a*, from which the dielectric membrane 68*a* is removed, the electrode layer formed outside the pattern of the electrode part 64 can be removed, thereby only allowing the electrode part 64 to remain.

Once the electrode part 64 is formed as described above, a pair of CPWs 66 are formed on either side of the electrode part 64. The CPWs 66 guide an RF signal that travels through the electrode part 64.

Here, a first sealing part 69, corresponding to the height of the CPWs 66, is simultaneously formed around the first substrate 62.

Referring to FIG. 4 again, in the step of preparing the second substrate module 70, a second insulation membrane 73 is formed on a second substrate 72, which is a base layer. The second insulation membrane 73 can be formed by stacking silicon nitride (SiNx), and silicon oxide can be additionally formed on a surface of the silicon nitride.

Then, a sacrificial layer 74 is formed on a surface of the second insulation membrane 73.

Once the sacrificial layer 74 is formed, a bias line 76 and a membrane 78 for connecting an internal circuit are formed above the sacrificial layer 74. Here, a second sealing part 79 corresponding to the CPWs 66 is simultaneously formed around the second substrate 72.

Next, some portion of the sacrificial layer 74 that is formed in a lower space of the membrane 78 is removed so that the membrane 78 can be deformed.

For this, the membrane 78 can be formed with a plurality of minute holes, through which a removal solution for the sacrificial layer 74 is flowed in to remove the sacrificial layer 74 formed in the lower space of the membrane 78.

Once the first substrate module 60 and the second substrate module 70 are prepared as described above, the first substrate module 60 and the second substrate module 70 are joined together.

Here, the membrane 78 of the second substrate module 70 is coupled to upper parts of the pair of CPWs 66 across an area above the electrode part 64 of the first substrate module 60.

Then, the first sealing part 69 and the second sealing part 79 are joined around the first substrate module 60 and the second substrate module 70 to seal the inside.

A via connecting part, which is electrically connected to an internal circuit that includes the electrode part 64 and the bias line 76, can be formed in a lower portion of the first substrate 62

Figure 5:
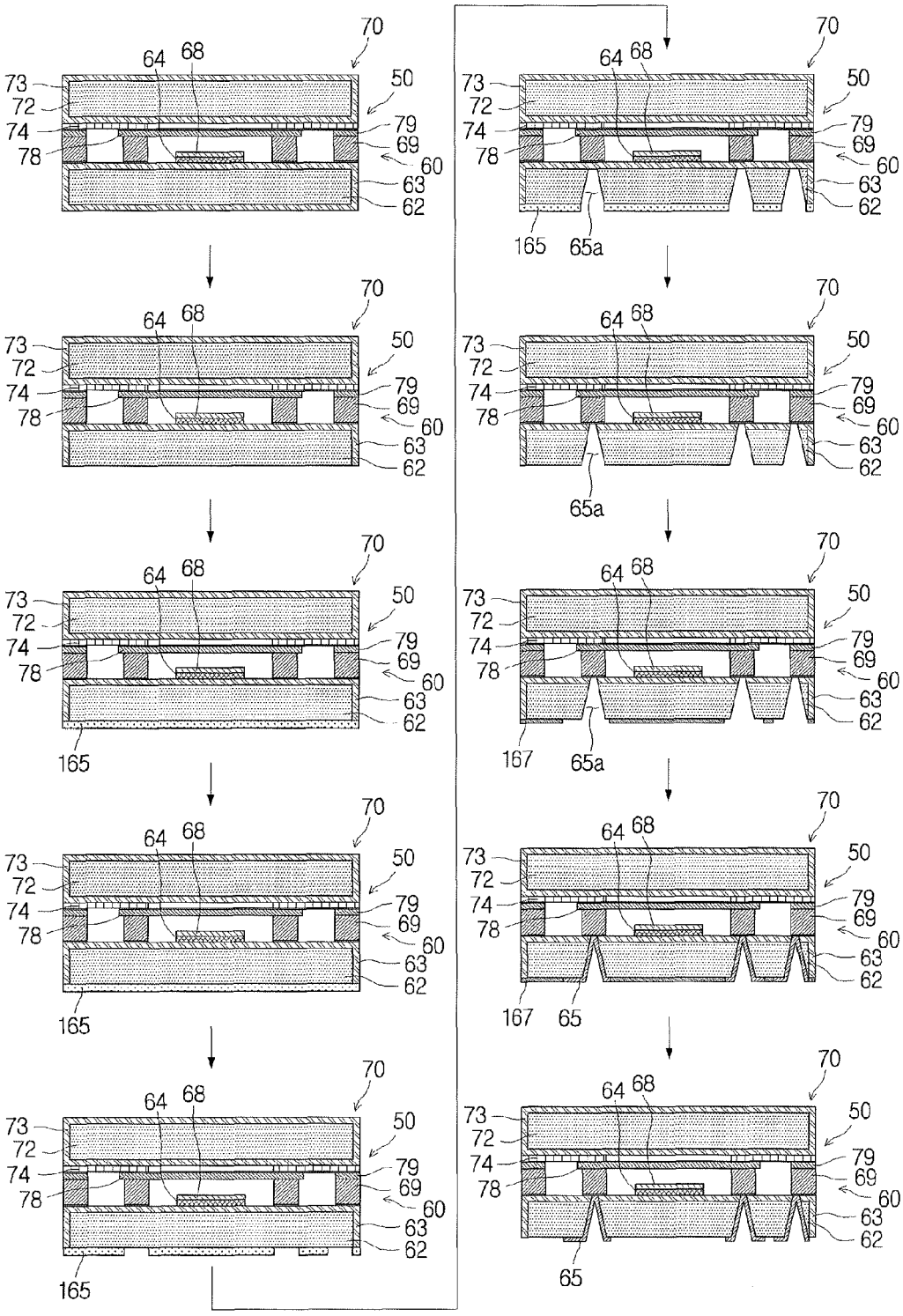
FIG. 5 shows sectional views of processes of forming a via connecting part in an electrostatic switch for high frequency in accordance with an embodiment of the present invention.

Referring to FIG. 5, which shows sectional views of processes of forming a via connecting part in an electrostatic switch for high frequency in accordance with an embodiment of the present invention, processes for forming a via connecting part 65 will be described below.

First, the first insulation membrane 63 formed in a bottom portion of the first substrate 62 is removed.

Then, a hard mask 165 for forming the via connecting part 65 is deposited in the bottom portion of the first substrate 62, and a pattern for removing the hard mask 165 where a via is to be connected is formed. Then, a via hole 65*a* that exposes the internal circuit through the pattern of the via connecting part 65 is formed in the bottom portion of the first substrate 62. Here, the via hole 65*a* can be formed by way of KOH or TMAH wet etching, and it is also possible to form the via hole 65*a* by use of Si deep etching. Moreover, it is also possible to form the via hole 65*a* through a process using laser.

Next, the hard mask 165, which has been deposited on the first substrate 62, is removed. Here, the insulation layer 63 that is deposited on the first substrate 62 at the bottom of the via hole 65*a* is removed at the same time.

Then, after forming a mask 167 for forming a pad in a lower portion of the first substrate 62, the via connecting part 65 is formed by forming a conductive material in the lower portion of the first substrate 62 and in the via hole 65*a*.

Once the via connecting part 65 is formed as described above, the mask 167 for forming the pad is removed.

Although certain embodiments of the present invention have been described, it shall be appreciated by anyone ordinarily skilled in the art to which the present invention pertains that there can be a variety of permutations and modifications of the present invention without departing from the technical ideas and scopes of the present invention that are disclosed in the claims appended below.

A large number of embodiments in addition to the above-described embodiments are present within the claims of the present invention.

What is claimed is:

1. An electrostatic switch for high frequency, comprising:

a first substrate module including a first substrate, an electrode part and a pair of CoPlanar Waveguides (CPWs), the electrode part being installed on the first substrate, the pair of CPWs being formed on either side of the electrode part and guiding an RF signal to travel; and a second substrate module being joined to the first substrate module, the second substrate module including a membrane and a bias line, the membrane being installed on a second substrate and bent by bias voltage supplied to the electrode part and being coupled to the pair of CPWs across an upper area of the electrode part in order to be short-circuited to the electrode part, the bias line being connected to the electrode part.

2. The electrostatic switch for high frequency of claim 1, further comprising a sealing part, the sealing part being installed on and sealing around at least one of the first substrate module and the second substrate module and maintaining a constant height.

3. The electrostatic switch for high frequency of claim 1, wherein a dielectric layer is stacked over the electrode part being short-circuited with the membrane.

4. The electrostatic switch for high frequency according to any one of claims 1 to 3, comprising a via connecting part, the via connecting part being formed on a rear surface of the first substrate module and being electrically connected to an internal circuit that includes the electrode part and the bias line.

5. The electrostatic switch for high frequency according to any one of claims 1 to 3, wherein the membrane is a conductive material including metal, poly-Si and SiC.

6. The electrostatic switch for high frequency according to any one of claims 1 to 3, wherein the first substrate module and the second substrate module are joined by use of at least one of Au—Au welding, eutectic bonding including Au—Sn, Au—In and Cu—Sn, and polymer bonding.

7. A method for manufacturing an electrostatic switch for high frequency, the method comprising:

preparing a first substrate module including a first substrate, an electrode part and a pair of CoPlanar Waveguides (CPWs), the electrode part being installed on the first substrate, the pair of CPWs being formed on either side of the electrode part and guiding an RF signal to travel;

preparing a second substrate module including a second substrate and a membrane, the membrane being installed on the second substrate and bent by bias voltage supplied to the electrode part and being short-circuited to the electrode part; and joining the first substrate module with the second substrate module so that the membrane is coupled to the pair of CPWs across an upper area of the electrode part.

8. The method of claim 7, wherein the preparing of the first substrate module comprises:

forming a first insulation membrane on the first substrate;

forming an electrode layer above the first insulation membrane;

forming a dielectric layer above the electrode layer;

removing areas of the dielectric layer other than an area of the dielectric layer corresponding to the electrode part;

forming the electrode part by removing the electrode layer exposed by removal of the dielectric layer; and forming the pair of CPWs on either side of the electrode part.

9. The method of claim 7 or 8, wherein the preparing of the second substrate module comprises:

forming a second insulation membrane on the second substrate;

forming a sacrificial layer above the second substrate on which the second insulation membrane is formed;

forming a membrane and a bias line above the sacrificial layer; and removing the sacrificial layer formed in a space in which the membrane is being deformed.

10. The method of claim 7 or 8, wherein the first substrate module and the second substrate module are joined by use of at least one of Au—Au welding, eutectic bonding including Au—Sn, Au—In and Cu—Sn, and polymer bonding.

11. A method for manufacturing an electrostatic switch for high frequency, the electrostatic switch for high frequency comprising a substrate, an electrode part installed on the substrate, a pair of CoPlanar Waveguides (CPWs) installed on either side of the electrode part, a membrane coupled to the CPWs, and a bias line connected to the electrode part, the method comprising forming a via connecting part in a bottom portion of the substrate, the via connecting part being electrically connected to an internal circuit that includes the electrode part and the bias line, wherein the forming of the via connecting part comprises:

removing a first insulation membrane in the bottom portion of the substrate;

forming a via hole in the bottom portion of the substrate, the via hole exposing the internal circuit through a pattern of the via connecting part; and connecting the internal circuit with an outside through the pattern of the via connecting part by forming a conductive material on the substrate and the via hole.

* * * * *